US005680662A

United States Patent [19]

Purdy et al.

[11] Patent Number: 5,680,662

[45] Date of Patent: Oct. 28, 1997

[54] CUSHIONING MATTRESS FOR REDUCING SHEAR AND FRICTION

[75] Inventors: William J. Purdy, White Plains, N.Y.; Roy E. Reed, Plainfield, Ind.; Kerry L. Jacobs, Mooresville, Ind.

[73] Assignee: Veritas Enterprises, Inc., White Plains, N.Y.

[21] Appl. No.: 709,638

[22] Filed: Sep. 9, 1996

[51] Int. Cl.[6] ..... A47C 27/00

[52] U.S. Cl. ..... 5/676; 5/677; 5/710; 5/909; 5/713

[58] Field of Search ..... 5/702, 909, 710, 5/685, 676, 677, 683, 709, 712, 711, 713

[56] References Cited

U.S. PATENT DOCUMENTS

| | | | |
|---|---|---|---|
| 2,691,179 | 10/1954 | Kann | 5/710 |
| 4,042,988 | 8/1977 | Holloday | 5/710 |
| 4,163,297 | 8/1979 | Naumark | 5/909 |
| 4,788,730 | 12/1988 | Bexton | 5/909 |
| 4,951,335 | 8/1990 | Eady | 5/710 |
| 5,323,500 | 6/1994 | Roe | 5/710 |

OTHER PUBLICATIONS

Hill-Rom, Flexicair® II Low Airloss Therapy Unit Brochure, Feb., 1995 (Four pages).

Hill-Rom, Flexicair Eclipse™ Low Airloss Therapy Unit Brochure, ©1996 (Six pages).

Cardio Systems, Pneu-Care® Series of frameless air support therapy (F.A.S.T.SM) Advertisement (One page), *Ostomy/Wound Management Journal*, vol. 40, No. 5, Jun., 1994.

*Primary Examiner*—Flemming Saether

*Attorney, Agent, or Firm*—Brinks Hofer Gilson & Lione

[57] ABSTRACT

A cushioning mattress is provided to normalize and distribute the weight of a patient's body to reduce the tangential forces bearing on the skin of the patient. The cushioning mattress comprises a top surface, a bottom surface and a series of alternating "tunnel" billows and "loop" billows. Each tunnel billow comprises a separate piece of material affixed to the top or bottom surface along two parallel seams to define a wide-based closed cell. Each loop billow comprises a separate piece of material affixed to the top or bottom surface along a single seam to define a narrow-based closed. Each tunnel and loop billow contains a visco-elastic material capable of conforming to any surface which it engages. The volume of the visco-elastic material contained in each loop billow is lesser than the volume contained in each tunnel billow such that the flowability of the material in each loop billow is greater than that of each tunnel billow, thereby permitting the upper surface of the mattress defined by the loop billows to engage and be adjacent the patient's skin to equalize the pressure bearing thereagainst.

5 Claims, 5 Drawing Sheets

CUSHIONING MATTRESS FOR REDUCING SHEAR AND FRICTION

FIELD OF THE INVENTION

This invention relates to cushioning devices and, more particularly, to a cushioning mattress for reducing tangential forces bearing against the skin of a human patient, particularly while in a supine position for an extended period.

BACKGROUND OF THE INVENTION

Various cushions and mattresses intended to provide a softer or more therapeutic surface upon which patients may lie are well known. For example, low air-loss mattresses and beds are commonly available in hospitals and other healthcare facilities intended to provide a softer cushion than a conventional fabric and spring or coil mattress. A common low air-loss mattress, shown in FIG. 1, comprises an air bladder having a series of billows or compartments, all in air communication with one another and which, through a series of fine holes or orifices, continuously releases air to the atmosphere. To maintain the low internal air pressure within the mattress to maintain its cushioning effect, an air pump is typically coupled to the mattress to continuously provide an influx of replacement air at low pressures.

The conventional low air-loss mattress shown in FIG. 1 is uncomfortable and fails to address the tangential forces, particularly shear pressure, applied to the patient's skin by the mattress. Shear pressure is an important factor in addressing bed sores. Moreover, if the head of the bed is raised, which is often done, the patient tends to slide downwardly on the mattress toward the foot of the bed.

There remains a need for a mattress or cushioning device that is more comfortable, that substantially reduces the amount of shear pressure asserted by the mattress or cushioning device against the patient's skin, that prevents the patient from sliding downwardly on the bed when the head of the bed is raised, and that avoids the "bottoming out" of the patient against the underlying surface, especially at bony prominences of the body, by better normalizing the weight of the patient about the surface of the mattress, all of which results in a mattress of much greater comfort and therapeutic benefit to the patient.

SUMMARY OF THE INVENTION

This invention provides means to better normalize and distribute the weight of the patient's body and to substantially reduce the tangential forces bearing on the skin of the patient by providing a cushioning mattress comprising a top surface, a bottom surface and a series of alternating "tunnel" billow compartments and "loop" billow compartments. Each of the tunnel billows comprises a separate piece of material affixed to the top or bottom surface along two parallel seams to define a wide-based closed billow or cell. Each of the loop billows comprises a separate piece of material affixed to the top or bottom surface along a single seam to define a narrow-based closed billow or cell.

Each of the tunnel loop billows contains a visco-elastic material that has the capability to conform to any surface which it engages. The volume of the visco-elastic material contained in each loop billow is lesser than the volume of material contained in each tunnel billow such that the flowability of the "looser" material in the loop billows is greater than that of the tunnel billows. This arrangement permits the upper surface of the mattress having greater flowability to engage and be adjacent the patient's skin to better accommodate any movement or pressure bearing thereagainst. The thicker, less flowable material contained in each tunnel billow acts as a supporting foundation for the overlying layer of loop billows.

Various portions of the human body impart varying pressures to a surface upon which the body lies. The mattress of this invention includes a specific arrangement of the tunnel and loop billows to accommodate these varying pressures. One preferred arrangement includes dividing the mattress into different sections corresponding to different areas of the body. For example, one section may correspond to the patient's head, another section may correspond to the thoracic area of the patient's body, a third section may correspond to the patient's buttocks and waist area, another may correspond to the legs of the patient, and a final section may correspond to the feet and heels of the patient. Within each such body section, a plurality of alternating tunnel-loop-tunnel billow compartments may be provided.

When downward pressure is applied to the mattress of this invention, typically be a patient lying or sitting upon the mattress, the loop billows tend to spread out to increase their surface areas in contact with the patient's skin, substantially covering and being supported by the underlying adjacent tunnel billows. Each of the loop billows tends to spread or flatten out because of its narrow base anchoring along a single seam and the support of the adjacent tunnel billows disposed on opposing sides of each loop billow. The tunnel billows, on the other hand, do not spread out to the same extent as do the loop billows because of their lower specific gravity and flowability, and because of their double-seam anchoring. In spreading or flattening out, the loop billows equalize the pressure asserted reactively by the mattress against the various portions of the body, thereby resulting in the even distribution of the patient's weight throughout the mattress and the prevention of undue pressure from being applied to any one particular body part or area. This further results in the substantial reduction of the friction and shear forces that may adversely act upon the skin of the patient, which reduces the potential of bed sores from forming, as well as aiding in the healing of sores already formed.

An alternative embodiment of a cushioning mattress provided by the invention comprises an upper layer defined by the mattress as described above including the series of alternating tunnel and loop billows, an intermediate layer defined by a conventional static air mattress, and a bottom layer defined by a layer of open-cell foam. The static air mattress serves to further normalize and equalize the pressures acting on a patient lying upon the mattress. The layer of open-cell foam defines a contouring base that slowly returns to its original shape after the applied weight or pressure is removed.

The invention is illustrated and described in more detail by the drawings and the detailed description of a preferred embodiment that follows.

BEST MODE FOR CARRYING OUT THE INVENTION

Figure 1:
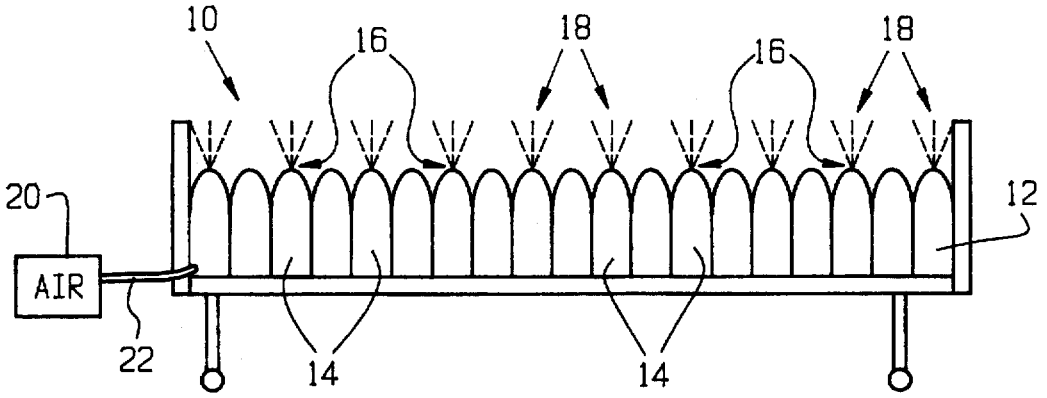
PRIOR ART Fig. 1
FIG. 1 is a side plan view of a prior art low air-loss volume mattress commonly found in healthcare facilities today.
Figure 2:
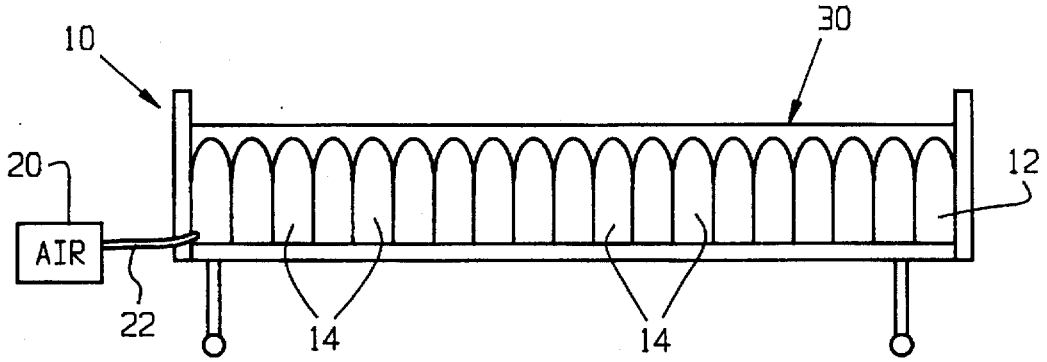
FIG. 2 is a side view of the cushioning overlay mattress provided by the invention shown disposed overlaying the prior art low air-loss volume mattress of FIG. 1.

Referring to the drawings, wherein like reference numerals designate identical or corresponding parts and elements throughout the several views, FIG. 1 presents a prior art low air-loss mattress 10 comprising an air bladder 12 having a series of billows or compartments 14, all in air communication with one another. In a typical low air-loss mattress, such billows are about nine inches (9") in height. Through a series of fine holes or orifices typically located at the uppermost point 16 of each billow 14, air is continuously and slowly released to the atmosphere as represented by a plurality of air flumes 18. While not shown in FIG. 1, a fine air-release orifice is typically provided in each of the billows of a low air-loss mattress; for purposes of clarity, however, a lesser number of air-release orifices and air flumes is shown in FIG. 1. In order to maintain the cushioning effect of air bladder 12, an air pump 20 can be coupled via fluid delivery line 22 to the bladder 12 to continuously provide an influx of replacement air to maintain a desired low internal air pressure within the mattress bladder. The pressure within the billows is dictated by the volume of air introduce into the bladder 12 by pump 20 and the volume of air escaping through the plurality of fine air-release orifices. Such mattresses commonly can be pre-programmed taking into consideration the height and weight of the patient.

As noted above, the conventional low air-loss mattress 10 shown in FIG. 1 is uncomfortable and fails to address the tangential forces, particularly shear pressure, asserted by the mattress surface and acting against the patient's skin. Shear pressure is a critically important factor in addressing bed sores, particularly for burn patients having damaged skin. Moreover, if the head of the bed is raised, which is routinely done to enable the patient to eat, read, watch television, converse with others, etc., the patient tends to slide downwardly on the mattress toward the foot of the bed. An low air-loss mattress also has poor pressure normalization abilities and, thusly, does not provide for even pressure distribution of the weight of the patient's body, thereby resulting in the phenomenon of "bottoming out," especially at bony prominences of the body, which results in the body of the patient coming into contact with the underlying bed frame 24.

Figure 3:
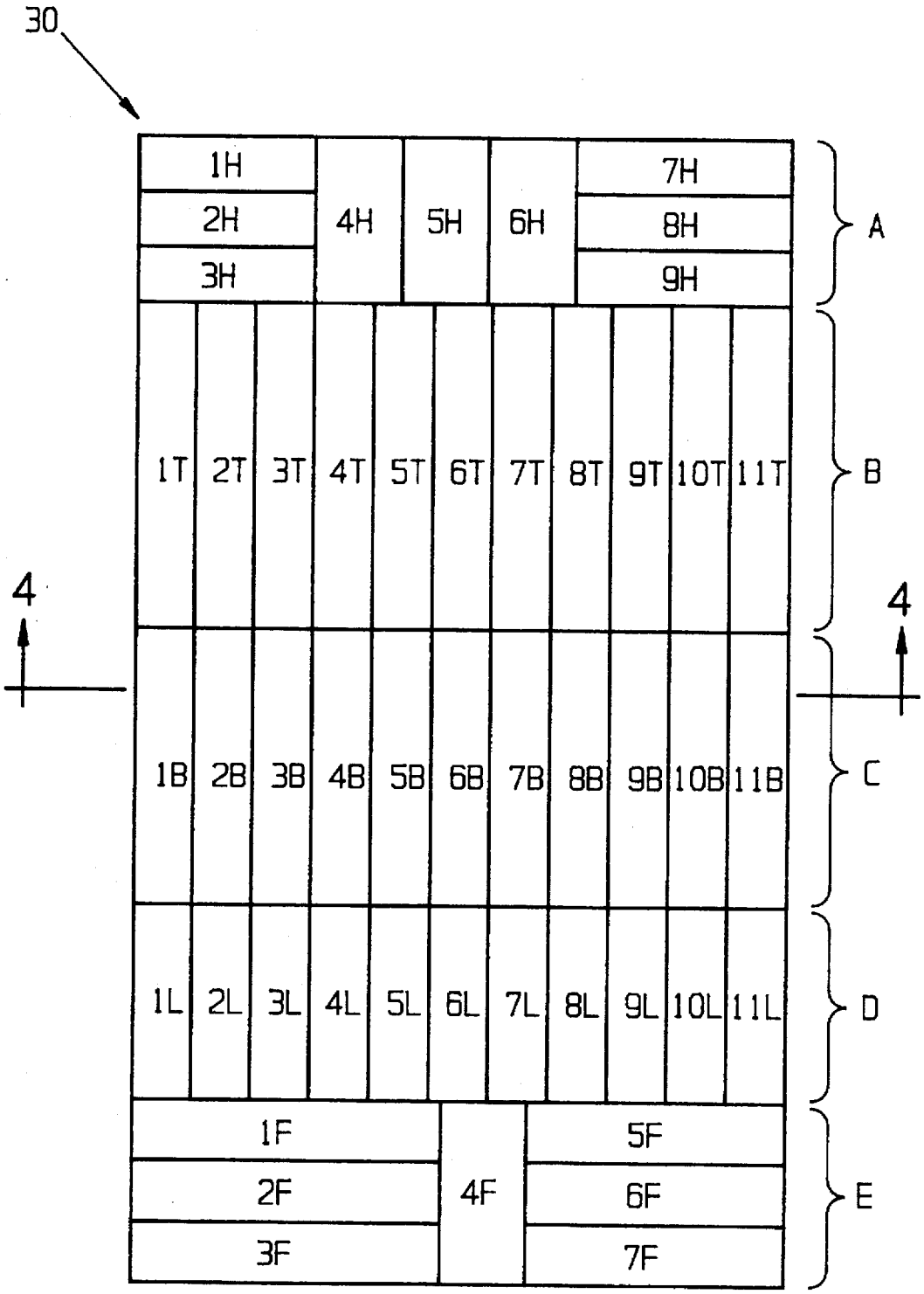
FIG. 3 is a top plan view of a particular arrangement, shown in an uncompressed state, of the tunnel and loop billow compartments in the construction of a cushioning mattress provided by this invention.
Figure 4:
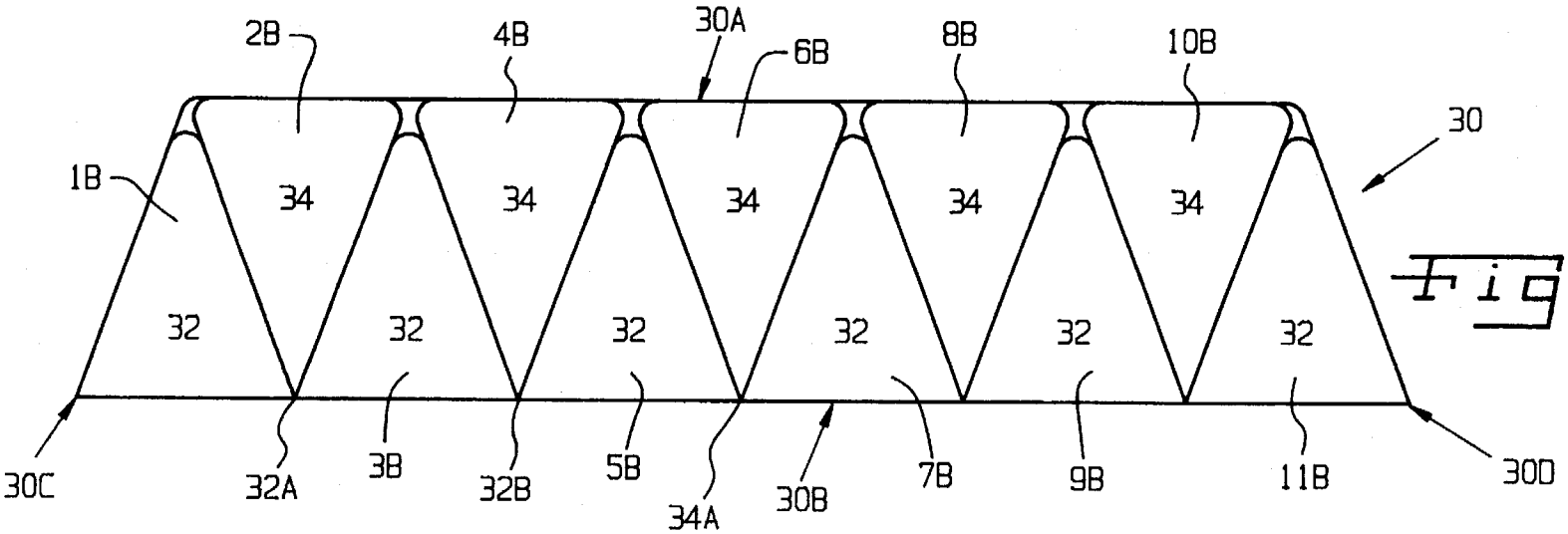
FIG. 4 is a cross section of the cushioning mattress provided by this invention in an uncompressed state as viewed along plane 4—4 of FIG. 3.

This invention provides means to better normalize and distribute the weight of the patient's body and to substantially reduce the tangential forces bearing on the skin of the patient by providing a cushioning mattress 30 as shown in FIGS. 2–8 comprising, referring particularly to FIGS. 3 and 4, a top surface 30A, a bottom surface 30B and a series of alternating "tunnel" billow compartments 32 and "loop" billow compartments 34. Top and bottom surfaces 30A and 30B are preferably coupled at the lower corners 30C and 30D of the mattress. The perimeters of overlay 30 all include a tunnel 32 for stability.

If desired the mattress 30, which has a specific gravity different than that of the low air-loss mattress 12, can be disposed overlying the conventional low air-loss mattress 10.

Each tunnel 32 of mattress 30 comprises a separate piece of material affixed to bottom surface 30B along two generally parallel seams 32A and 32B to define a wide-based closed billow or cell. Each loop 34 comprises a separate piece of material affixed to bottom surface 30B along a generally linear single seam 34A to define a narrow-based closed billow or cell. Seams 32A, 32B and 34A can coincide along a common linear path along the bottom surface, or be affixed at separate distinct linear regions along bottom surface 30B. Alternatively, the tunnel and loop billows could be attached to the top surface 30A if desired.

Each tunnel 32 and loop 34 contains a visco-elastic material, akin to shaving cream, that conforms to any surface which it engages. The volume per unit of area of the visco-elastic material contained in each loop 34 is lesser than the volume per unit area of material contained in each tunnel 34 such that the "looser" material in each loop 34 has a greater flowability than that of each tunnel 32. Consequently, the specific gravity of the material in each loop 34 is lesser than that of each tunnel 32. This arrangement permits the upper surface with greater flowability to engage and be adjacent the patient's skin to better accommodate any movement or pressure bearing against the mattress 30, typically brought about by the weight of the patient and any body movement while the patient is in a supine position. The thicker, less flowable material contained in each tunnel 32 serves as a foundation for the loops 34. A suitable visco-elastic material meeting the specifications of this invention is available from Genesis, Inc. under the product name FLOAM.

Research into in vivo measurement of large area tissue interface pressures utilizing force sensing arrays indicates that various portions of the human body impart varying pressures to a surface upon which the body lies. Mattress 30, shown in an uncompressed state in a top plan view in FIG. 3, includes a specific arrangement of the tunnel and loop billow compartments 32, 34 to accommodate these varying pressures. One preferred arrangement shown in FIG. 3 is defined by a section A corresponding to the patient's head, a section B corresponding to the thoracic area of the patient's body, a section C corresponding to the patient's sacral/coccyx area (buttocks and waist area), a section D corresponding to the legs of the patient, and a section E corresponding to the feet and heels of the patient.

Each body section A through E separately comprises a plurality of alternating tunnel-loop-tunnel compartments. Head section A comprises tunnel 1H ("H" for head), loop 2H, tunnel 3H, tunnel 4H, loop 5H, tunnel 6H, tunnel 7H, loop 8H and tunnel 9H. Thoracic area section B comprises alternating tunnels referenced by odd numerals 1T–11T ("T" for thorax) and loops referenced by even numerals 2T–10T. Sacral/coccyx area section C comprises alternating tunnels referenced by odd numerals 1B–11B ("B" for buttocks) and loops referenced by even numerals 2B–10B. Legs section D comprises alternating tunnels referenced by odd numerals 1L–11L ("L" for legs) and loops referenced by even numerals 2L–10L (FIG. 4 is a cross section view taken along plane 4—4 extending through this section D of the mattress). Finally, feet and heels section E comprises tunnel 1F ("F"

for feet), loop 2F, tunnel 3F, tunnel 4F, tunnel 6F, tunnel 6F, loop 7F and tunnel 8F.

Figure 7:
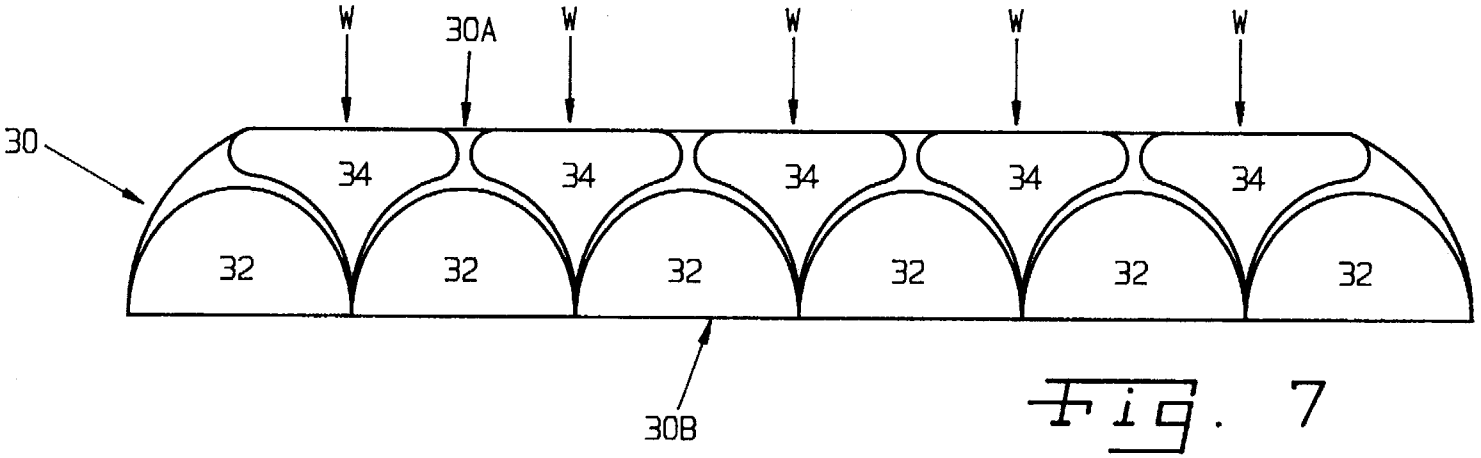
FIG. 7 is a cross section of the cushioning mattress of FIG. 3 in a compressed state as viewed along plane 7—7 of FIG. 6.
Figure 6:
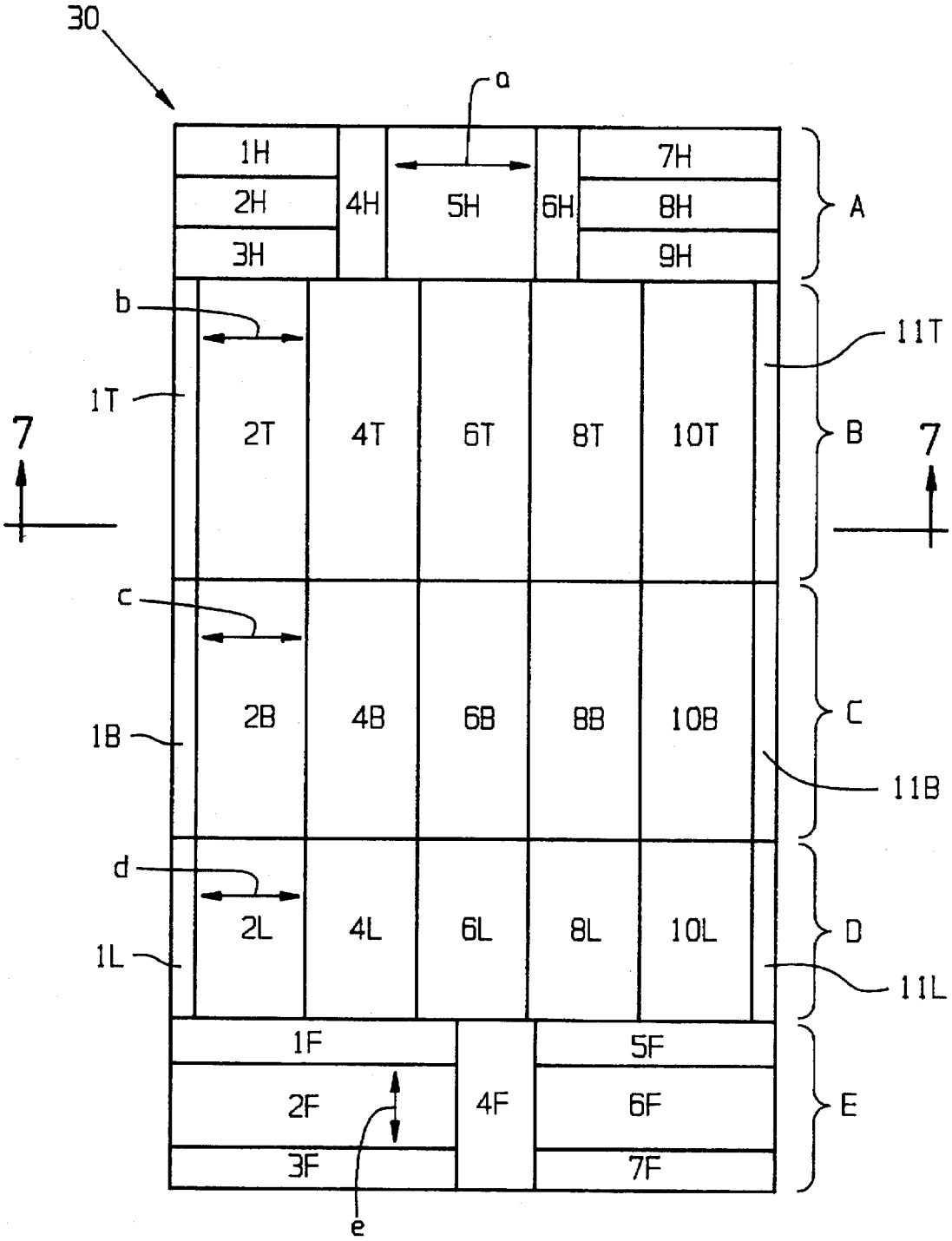
FIG. 6 is a top plan view of the tunnel and loop billow compartment arrangement shown in FIG. 3 depicted in a compressed or weight-bearing state.

The areas of greatest pressure asserted against a human body in a supine position include the back of the patient's head, the thoracic area (particularly the shoulder blades), the "tail bone" area, and the right and left heels. FIG. 6 is a top plan view of the tunnel and loop billow compartment arrangement of mattress 30 shown depicted in a compressed or weight-bearing state showing how the loops 34 tend to spread out to increase their surface in contact with the patient's skin substantially covering the adjacent tunnels 32. FIG. 7 is a cross section of the cushioning mattress of FIG. 6 shown in a compressed state as viewed along plane 7—7 of FIG. 6. Here it can best be seen that upon the application of downward pressure upon the top of the mattress as shown by reference arrows W (weight) in FIG. 7, loops 34 tend to spread or flatten out while being supported underneath by the adjacent tunnels 32. Tunnels 32 do not spread out to the same extent as do loops 34 because of their lower specific gravity and flowability. When a patient is disposed in a supine position upon mattress 30, loop 5H will flatten out as shown in FIG. 6, represented by reference double-arrow a, to equalize the pressure caused by the rear of the head. The spreading out of loop 5H results in the compression of adjacent tunnels 4H and 6H. In thoracic area B, buttocks and waist area C, and legs section D, the even-numbered loops 2T–10T, 2B–10B, and 2L–10L, respectively, will similarly each flatten out, represented by exemplary reference double-arrows b, c and d, to equalize the pressure caused by those respective body portions. This results in the compression of the alternating adjacent tunnel compartments. In the feet and heels section E, loop compartments 2F and 6F will also typically flatten out, represented by exemplary reference double-arrow e, to equalize the pressure caused by the heels of the feet, thereby resulting in the compression of adjacent tunnel compartments 1F, 3F and 5F, 7F, respectively. A patient's heels, particularly those of elderly patients, are quite vulnerable to bed sores. As noted above, each loop compartment 34 tends to spread or flatten out because of the greater flowability of the viscous material contained therein and the narrow base anchoring along a single seam 34A while being supported by the adjacent tunnels 32 on opposing sides of each loop 34.

FIG. 7 depicts a cross section of the mattress 30 in a compressed or weight-bearing state, as compared to FIG. 3 which shows a cross section of mattress 30 in an uncompressed or static state, viewed along plane 7—7 of FIG. 6 extending through the thoracic area section B of the mattress 30. When a patient is in the supine position, his or her weight naturally bears against and compresses the mattress 30 in a manner similar to that shown in FIG. 7. Due to the single-seam attachment of each loop 34, and the greater degree of flowability of the material within each loop 34 than that of each tunnel 32, each loop 34 has a tendency to spread or flatten out to a greater extent than its adjacent supporting tunnels 32. The greater flowability of the material contained within each of the loops 34 engaging the patient's skin results in less friction and shear forces adversely acting upon the skin of the patient, thereby reducing the potential of bed sores from forming, as well as aiding in the healing of sores already formed.

Figure 5A:
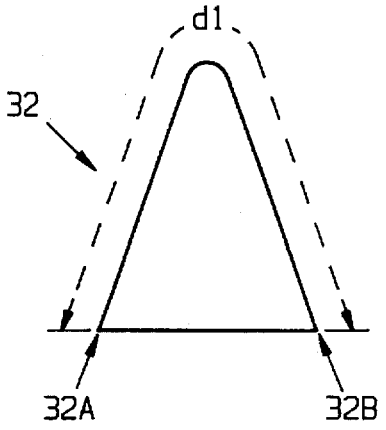
FIGS. 5A and 5B are isolated plan views of the tunnel billow compartments and loop billow compartments, respectively, of the cushioning mattress of this invention.
Figure 5B:
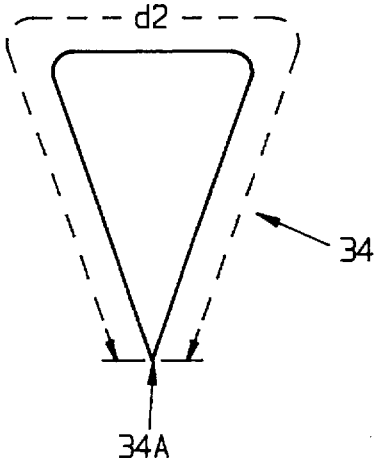

Top and bottom surfaces 30A and 30B, tunnels 32 and loops 34 of the mattress 30 can be defined by thin polyurethane sheet material in the order of about 15 mm of thickness. As shown in FIGS. 5A and 5B, the cross width d1 of the sheet material from which tunnel 32 is constructed is preferably about ten inches (10"), whereas the cross width d2 of the sheet material from which loop 34 is constructed is preferably about thirteen inches (13"). Preferably, the sheet material should have the ability to stretch in one direction with minimum stretching capability in a direction normal to the direction of stretch. A suitable polyurethane sheet material is available also from Genesis, Inc. under the product name LYCRA, which has the desirable capability of readily sliding upon itself when pressure applied to a loop 34 compresses the adjacent tunnels 32. All seams present in the mattress 30 can be achieved by conventional radio frequency (RF) or ultrasonic welding techniques.

Figure 8:
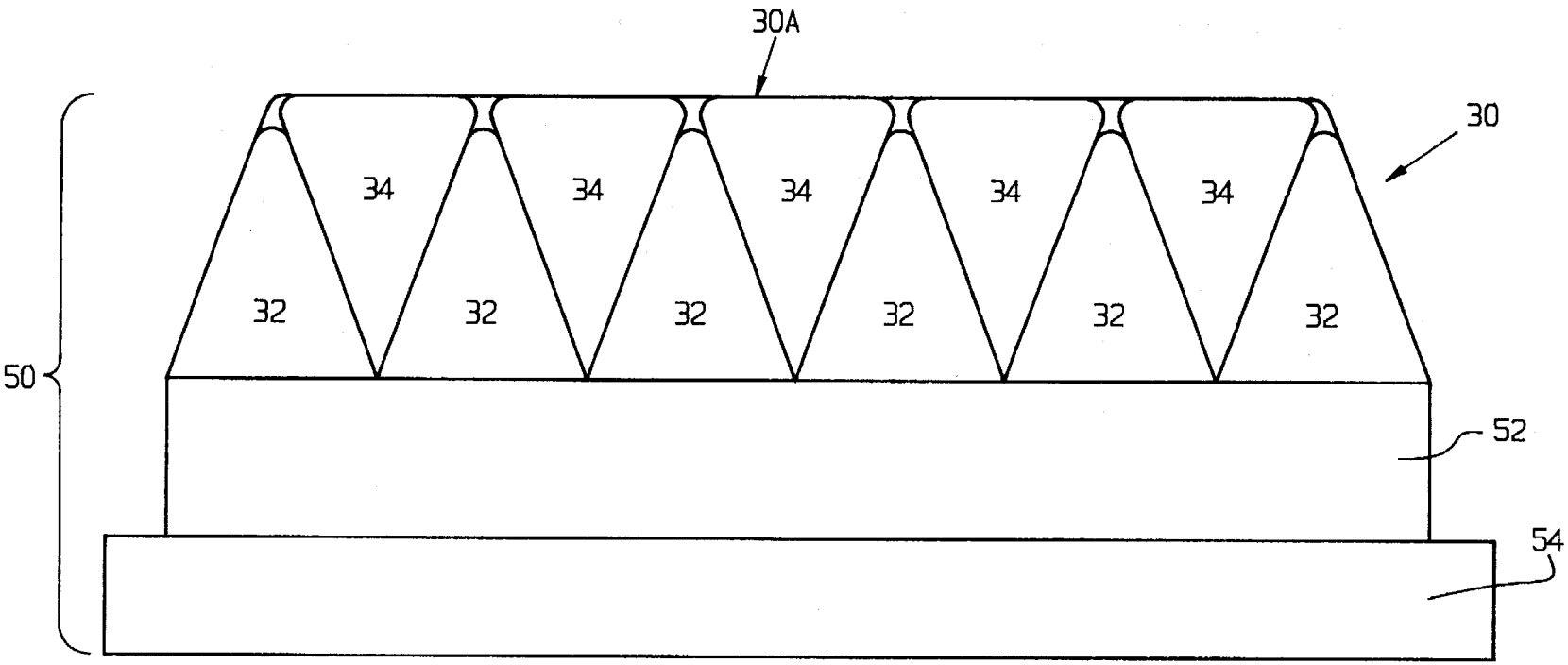
FIG. 8 is a cross section view of an alternative embodiment of a cushioning mattress provided by this invention.

An alternative embodiment of a cushioning mattress 50 provided by the invention is shown in FIG. 8 comprising an upper layer 30 defined by the mattress 30 as described above including the series of alternating tunnels 32 and loops 34, a lower layer 54 defined by a layer of open-cell foam, and an intermediate layer 52 defined by a static air mattress. Static air mattress 52 can be any conventional static air mattress commonly available from various suppliers in the market to normalize and equalize the pressures acting on a patient lying in a supine position. The lowermost layer of open-cell foam 54 of mattress 50 defines a contouring base that slowly returns to its original shape after the weight or pressure is removed.

The cushioning mattresses provided by this invention have been described as disclosed above in connection with the preferred embodiments as shown in FIGS. 1–8. It must be understood, however, that there are other embodiments and variations of the invention which may be developed and that the invention is not limited to the preferred embodiment and best mode of operation currently understood, but is only to be limited by the scope of the following claims.

We claim:

1. A cushioning mattress for reducing the tangential forces acting upon the skin of a patient lying upon the mattress, comprising:

a top surface;

a bottom surface; and a series of alternating tunnel billow compartments and loop billow compartments disposed between the top and bottom surfaces, each said tunnel billow compartment including a separate piece of material affixed along two generally parallel seams to the top or bottom surface to define a wide-based closed cell, each said loop billow compartment including a separate piece of material affixed along a single seam to the top or bottom surface to define a narrow-based closed cell, each said tunnel and loop billow compartment containing a visco-elastic material having the capability to conform to any surface which it engages, the volume per unit of area of said visco-elastic material contained in each loop billow compartment being lesser than the volume of said material contained in each said tunnel billow compartment.

2. The cushioning mattress as in claim 1 wherein each said loop billow compartment has a degree of flowability greater than that of each tunnel billow compartment.

3. The cushioning mattress as in claim 1 wherein any two of said tunnel billow compartments act as an underlying supporting foundation for an intervening loop billow compartment disposed therebetween.

4. The cushioning mattress as in claim 1 wherein upon the application of pressure generally downwardly upon the top surface of said mattress, each said loop billow compartment flattens out and compresses adjacent tunnel billow compartments, thereby equalizing the reactive pressure asserted by said mattress against the body of the patient.

5. A cushioning mattress for reducing the tangential forces acting upon the skin of a patient lying upon the mattress, comprising:

a top layer;

a bottom layer; and and intermediate layer, said top layer including:

a top surface;

a bottom surface; and a series of alternating tunnel billow compartments and loop billow compartments disposed between the top and bottom surfaces, each said tunnel billow compartment including a separate piece of material affixed along two generally parallel seams to the top or bottom surface to define a wide-based closed cell, each said loop billow compartment including a separate piece of material affixed along a single seam to the top or bottom surface to define a narrow-based closed cell, each said tunnel and loop billow compartment containing a visco-elastic material having the capability to conform to any surface which it engages, the volume per unit of area of said visco-elastic material contained in each loop billow compartment being lesser than the volume of said material contained in each said tunnel billow compartment, said intermediate layer including a static air pressure mattress, said bottom layer including an open-cell foam layer.

* * * * *